US006759994B2

(12) United States Patent
Rao et al.

(10) Patent No.: US 6,759,994 B2
(45) Date of Patent: Jul. 6, 2004

(54) MULTIPLE BEAM ANTENNA USING REFLECTIVE AND PARTIALLY REFLECTIVE SURFACES

(75) Inventors: Sudhakar K. Rao, Torrance, CA (US); Philip H. Law, Encino, CA (US); Robert Lee Reynolds, Newbury Park, CA (US); George Voulelikas, El Segundo, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/206,451

(22) Filed: Jul. 26, 2002

(65) Prior Publication Data

US 2004/0017332 A1 Jan. 29, 2004

(51) Int. Cl.[7] ..... H01Q 15/02; H01Q 19/00
(52) U.S. Cl. ..... 343/912; 343/781 P
(58) Field of Search ..... 343/781 P, 756, 343/909, 912

(56) References Cited

U.S. PATENT DOCUMENTS 6,140,978 A 10/2000 Patenaude et al.

6,563,472 B2 * 5/2003 Durham et al. ..... 343/781 P

OTHER PUBLICATIONS

S. Rao, "Design and Analysis of Multiple–Beam Reflector Antennas", IEEE Antennas & Propagation Magazine, vol. 41, #4, pp. 53–59, Aug. 1999.

S. Rao, G. Morin, M. Tang, S. Richard and K.K. Chan, "Development of a 45 GHz Multiple–Beam Antenna for Military Satellite Communications", IEEE Trans. Antennas & Propagation, vol. 43 pp. 1036–1047, Oct. 1995.

* cited by examiner

*Primary Examiner*—James Clinger
(74) *Attorney, Agent, or Firm*—Terje Gudmestad

(57) ABSTRACT

A hybrid reflector antenna particularly suited for reflecting a frequency band in a satellite includes a central portion fully reflective to the frequency band. A first annular band is disposed directly adjacent to the central portion. The first annular band is partially reflective to the frequency band. The reflector may include several annular bands having various degrees of reflectivity and thus attenuation. The present invention may be implemented using two such reflectors, one for transmitting and one for receiving in a satellite, for either single or multiple beam applications. This invention offers more compact and lower mass/cost antenna configurations compared to conventional antennas from multiple beam satellite payloads.

20 Claims, 8 Drawing Sheets

- - - 45" Conventional Reflector
—— 75" Reflector of Present Invention

MULTIPLE BEAM ANTENNA USING REFLECTIVE AND PARTIALLY REFLECTIVE SURFACES

TECHNICAL FIELD

The present invention relates generally to communication satellites, and more particularly, to a reflector configuration for communication satellites.

BACKGROUND ART

Communication satellites employing multiple spot beam payloads typically require either multiple reflector antennas (3 or 4 apertures) or a single reflector with a complex beamforming network for efficient transmission as well as receiving functions. The transmission function is to be referred to as a downlink and the receiving function is referred to as an uplink. Typically, multiple reflector antennas (3 or 4) for each transmit and receive frequency band are employed. The disadvantage with this approach is that more physical space on the spacecraft body is required to mount the antennas. That is, typically both the east and west sides of the spacecraft are used for the reflectors while leaving only the nadir panel for other payloads. The reflector systems are also heavier and require larger feed horns.

Another approach is a single reflector for each frequency band and the employment of a large number of feed horns with a low-level beamforming network dedicated to each reflector. Each beam is generated by an overlapping cluster of horns, typically seven, and requires an element sharing network and a beamforming network to form multiple overlapping beams. One disadvantage of this approach is that a large number of feeds, a large number of amplifiers, and complex and heavy beamforming networks are required. This increases the complexity of the spacecraft.

Another approach is using a solid reflector with a frequency selective surface (FSS) subreflector with separate feed arrays. The FSS subreflector transmits the downlink frequencies and reflects the uplink frequencies. The number of main reflectors is reduced by a factor of two relative to the first described approach, but it requires an additional frequency selective subreflector for each main reflector. One disadvantage of this approach is that complex frequency selective surface subreflectors require more area to package on a spacecraft and the increased loss associated with the FSS subreflector which impact electrical performance.

Yet another approach is described in U.S. Pat. No. 6,140,978. In the '978 patent a frequency selective surface main reflector and dual-band feed horns are used. The '978 patent employs one set of reflectors where each reflector has a central solid region that is reflective to both frequency bands and an outer ring that is selective to the frequencies and is reflective at downlink frequencies and non-reflective at uplink frequencies. Thus, the electrical size of the reflector is therefore different at the two bands and thus can be adjusted to achieve the same coverage on the ground. Disadvantages of this approach are that the losses associated with the reflector are increased, the increased complexity of the reflector itself, and the increased cost and the need to diplex the feed horn results in bandwidth and passive-intermodulation issues. Although the number of reflectors is reduced by a factor of two, three or four reflectors are still required.

It would therefore be desirable to provide a simple lightweight size for an antenna reflector to reduce the overall complexity and weight of the spacecraft.

SUMMARY OF THE INVENTION

It is therefore one object of the invention to provide a simplified antenna configuration for a spacecraft.

An important aspect of this invention is the use of a single "hybrid reflector" with combination of fully reflective and partially reflective surfaces in order to generate multiple beams.

In one aspect of the invention, an antenna for reflecting a frequency band comprises a central portion fully reflective to the frequency band. A number of annular bands surrounding the central portion are used with partially reflective surfaces. A first annular band is disposed directly adjacent to the central portion. The first annular band is partially reflective to the frequency band.

It should be noted that the antennas may be incorporated into a satellite wherein one antenna is used for transmitting and one antenna is used for receiving all the beams in the satellite. Because of the use of a single reflector to generate all beams within a frequency band, performance degradation due to differential pointing error among multiple apertures of a conventional design is eliminated.

One advantage of the invention is that the number of reflectors is reduced which in turn reduces the complexity and size of the spacecraft. Another advantage of the invention is that because a reduced number of reflectors are used, more space is available on the exterior of the satellite for various types of payloads. Yet another advance of this invention is that it does not require complex beam forming networks to form beams.

Other advantages and features of the present invention will become apparent when viewed in light of the detailed description of the preferred embodiment when taken in conjunction with the attached drawings and appended claims.

BEST MODES FOR CARRYING OUT THE INVENTION

Figure 1:
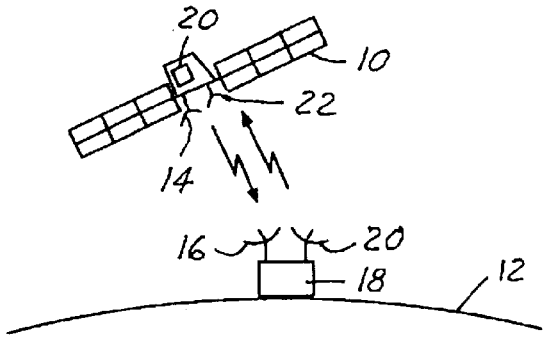
FIG. 1 is a plan view of a satellite having antenna reflectors according to the present invention.

In the following figures the same reference numerals will be used to identify the same components. While the present invention is illustrated with respect to a satellite-based antenna, the present invention may also be applied to ground based antennas.

Referring now to FIG. 1, a satellite 10 is illustrated above earth 12. Satellite 10 has a transmitting antenna 14 that transmits signals to a ground-based antenna 16 on a ground station 18. Of course, ground station 18 may include homes, businesses, or a central redistribution point for the satellite signals.

Satellite 10 also includes a receiving antenna 22 that receives signals from a transmitting antenna 20 on the ground. In a preferred embodiment of the invention only one transmitting antenna 14 and one receiving antenna 22 are required on the present invention. Thus, the overall number of antennas is reduced.

Figure 2:
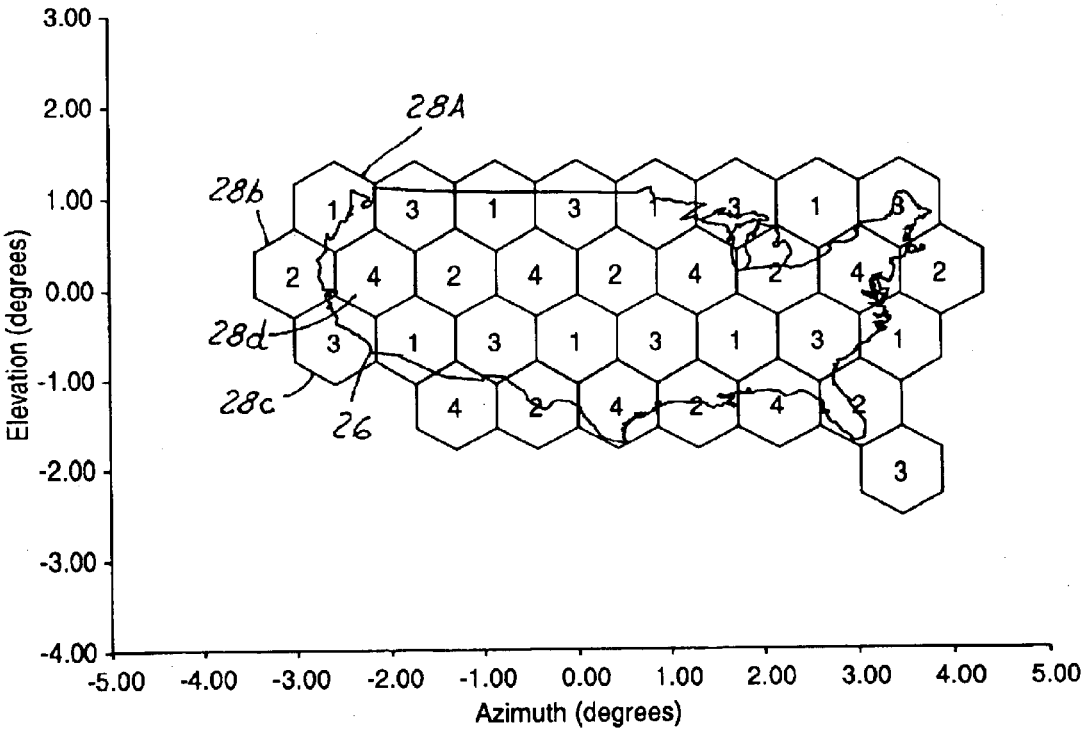
FIG. 2 is a map view of the United States having continuous coverage using 32 contiguous spot beams.

Referring now to FIG. 2, the Continental United States (CONUS) 26 is illustrated using 32 contiguous spot beams that are represented in hexagonal form. The representations are illustrated by reference numerals 28A, 28B, 28C, and 28D and thus four-pattern reuse is illustrated. In this figure the cell spacing is 0.866 degrees and the beam size is 1.0 degrees.

Figure 3:
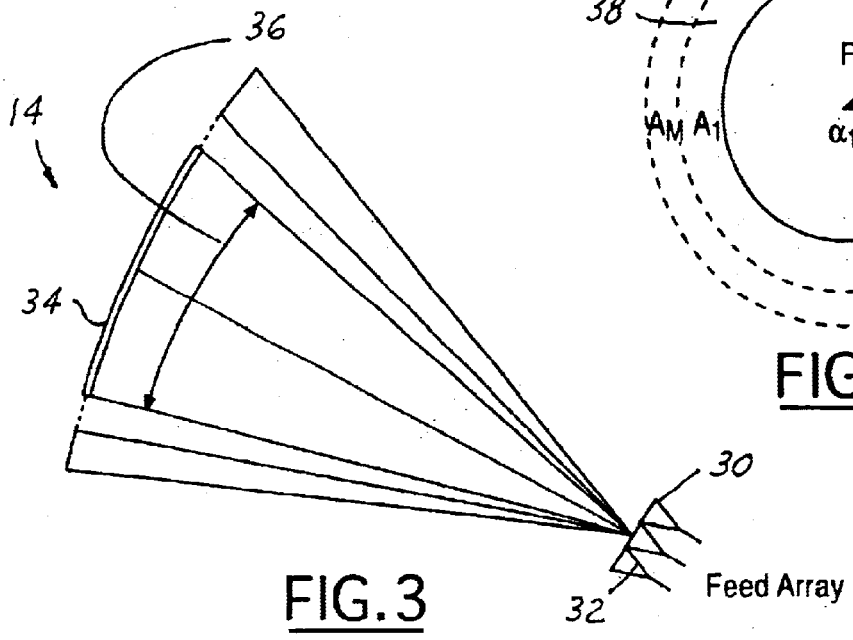
FIG. 3 is a cross-sectional view of a reflector and feed array according to the present invention.

Referring now to FIG. 3, antenna 14 is illustrated in further detail. Antenna 14 is shown relative to feed array 30. Of course both antennas 14 and 22 may be configured according to the present invention. In the preferred embodiment of the present invention, each reflector has its own feed array which may be located in the focal plane as illustrated or defocused from the focal plane. Although only three feed horns 32 are illustrated in feed array, the number of feed horns corresponds to the number of beams in a multiple beam satellite system. The feed array 30 illuminates the reflector 34 in an offset configuration to eliminate blockage effects. The surface profile of the reflector 34 could be parabolic or can be arbitrarily shaped.

Figure 4:
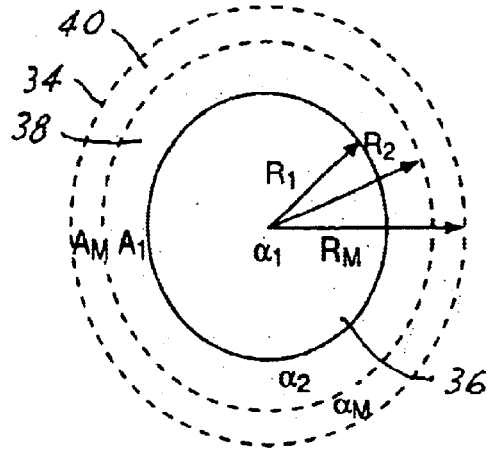
FIG. 4 is an elevational view of a reflector formed according to the present invention.
Figure 5:
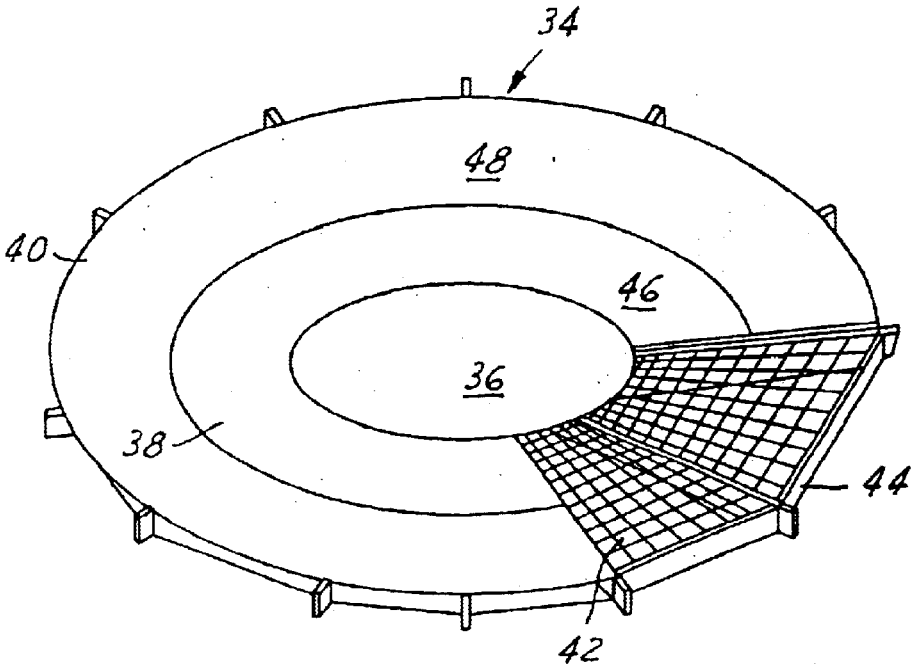
FIG. 5 is a perspective view of the reflector formed according to the present invention.

Referring now to FIGS. 3, 4, and 5, reflector 34 is illustrated in further detail. Reflector 34 has a central portion 36 that comprises a solid reflector portion. The solid reflector portion is fully reflective to the RF signals of the bandwidth of interest. As illustrated in FIG. 4, central portion 36 has a radius $R_1$. The reflector also has at least one, but as illustrated, m>1 ($m \geqq 2$) partially reflective and partially absorptive rings (only two rings 38 and 40 are shown in FIGS. 3 to 5 for the sake of clarity). Ring 38 has an outer radius $R_2$ and an inner radius $R_1$ and thus is directly adjacent to central portion 36. Ring 40 has an inner radius $R_2$ and an outer radius $R_M$. Each ring may be concentric with the central portion 36. Shape of each ring is typically circular but also can take other geometrical forms.

Each of the rings 38, 40 may be formed from an electrically thin (a thickness much less than the skin depth) layer of resistive film such as vacuum deposited nickel chromium (nichrome) on Kapton® which has been bonded to a sparse mesh of graphite. Mesh 42 is illustrated in FIG. 5. Mesh 42 is supported by a backing structure 44. The Kapton® substrate of ring 38 is generally illustrated as 46 and the Kapton® substrate of ring 40 is generally illustrated as 48. The Kapton® substrate 46 of the inner ring may, for example, have a resistivity of 187 Ohms per square. The Kapton® substrate of the outer ring 40 may have a higher resistivity per square such as 555 Ohms per square. By controlling the size of the rings and the resistance of the rings the desired beam shape can be achieved by optimizing the feed illuminating on the hybrid reflector.

In one constructed embodiment, the mechanical implementation of the hybrid reflector included a graphite ribbed backing structure to support the various components of the reflector, a solid graphite shell constructed of three to four layers of triaxial weave with a dense mesh, a graphite sparse mesh with a minimal opening of 0.45 inch attached to the backing structure.

Figure 6A:
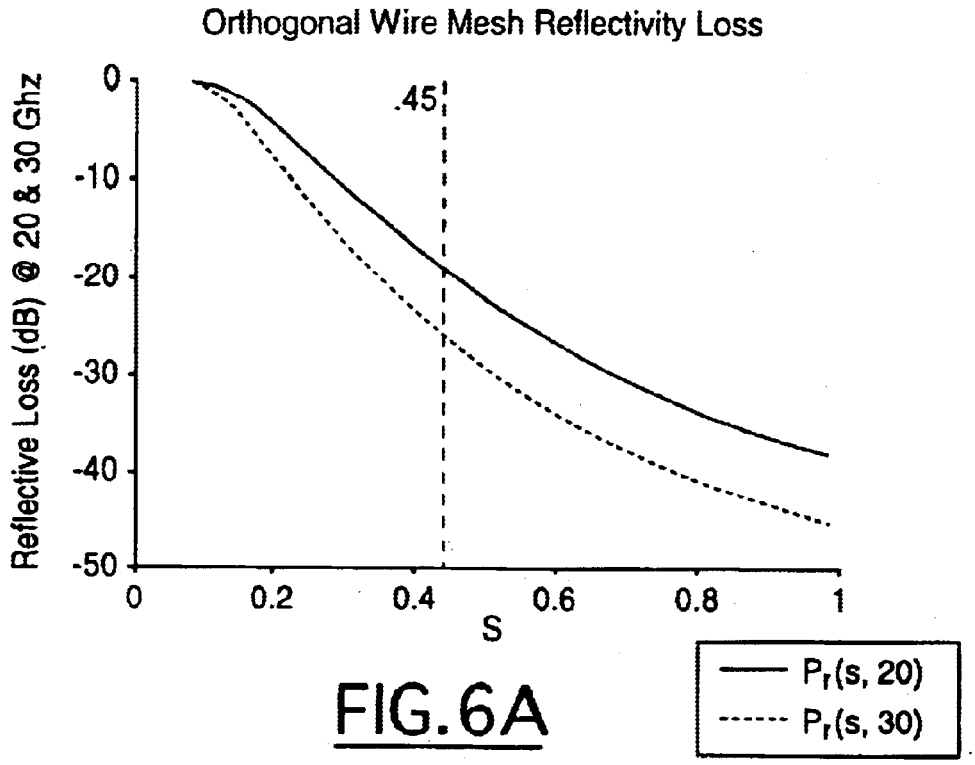
FIG. 6A is a plot of reflectivity loss with a 0.02 inch grid thickness.

In an alternative configuration the mesh may be positioned over the ribbed backing structure by a network of dimensionally stable catenary network that run from rib to rib. The mesh may be used to create the desired reflector surface over the outer annulus and a Kapton® substrate composed of nichrome film coating may be mounted on the rib backing structure or the mesh depending on the desired configuration. The grid design for the outer rings may be accomplished by a proper selection of the grid parameter such as grid thickness and grid spacing so that the mesh is transparent to RF signals. For example, a grid design for two outer rings at Ka-band frequency 20 GHz downlink and 30 GHz uplink can be employed using a symmetrical graphite mesh of 0.02 inch thickness with 0.45 inch spacing between the grids to achieve the desired electrical transparency and low reflectivity at Ka-band. As illustrated in FIG. 6A, computed reflectivity loss is about 20 dB at 20 GHz and 26.5 dB at 30 GHz.

Figure 6B:
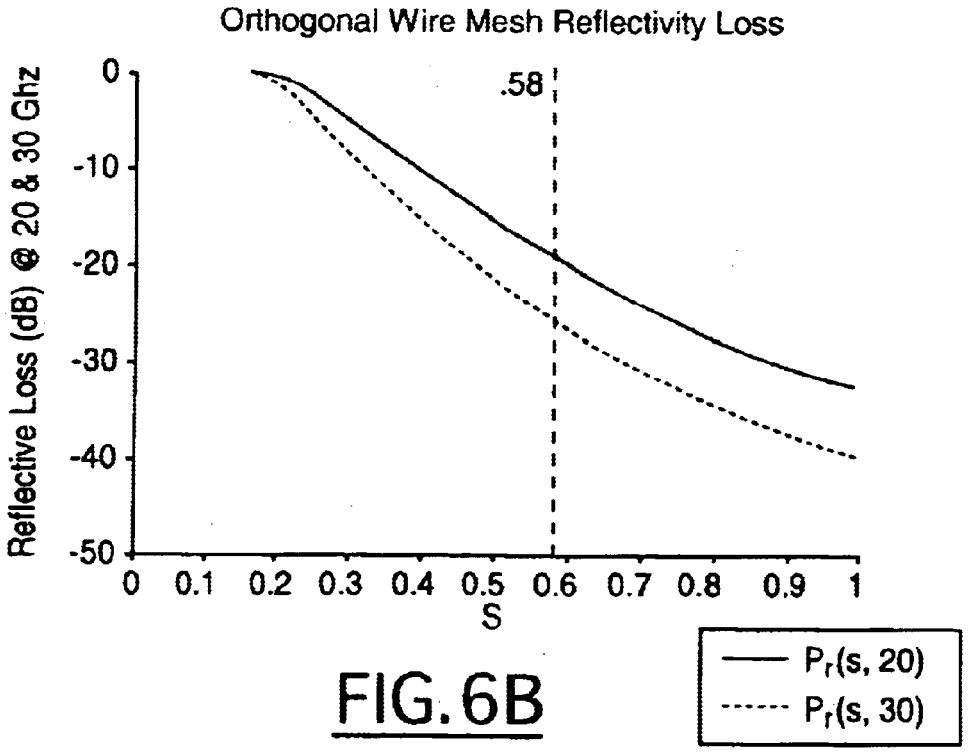
FIG. 6B is a plot of the orthogonal wire reflectivity loss for a grid of 0.04 inch thickness.

Referring now to FIG. 6B, another way in which to employ Ka-band frequencies is to use a symmetric graphite mesh of 0.04 inches with a 0.58 inch grid spacing that provides a reflectivity loss of 20 dB and 27 dB at 20 GHz and 30 GHz, respectively.

Figure 7:
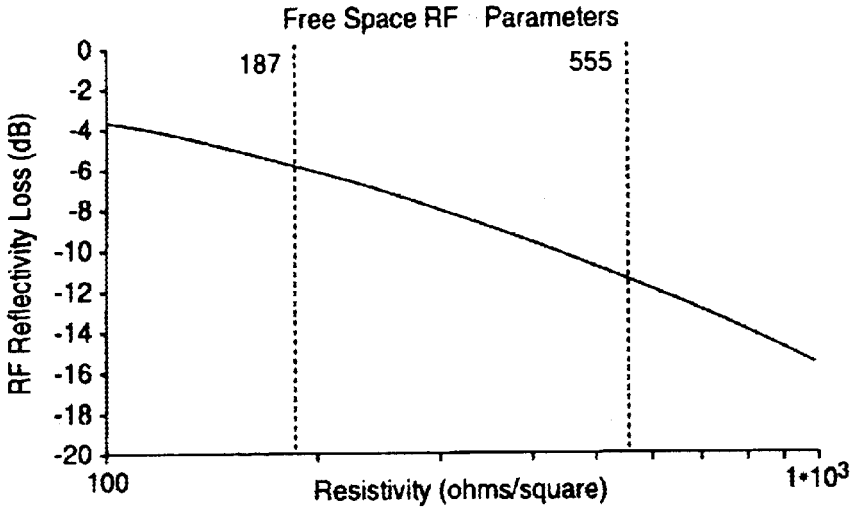
FIG. 7 is a reflectivity loss versus resistivity of nichrome film.

Referring now to FIG. 7, the variation of RF reflectivity loss or the attenuation for different resistivity values of the nichrome film is illustrated. For example, the proposed design has approximately 187 Ohms per square resistivity to achieve 6 dB reflectivity loss for the inner ring A1 and approximately 555 Ohms per square resistivity to achieve 12 dB reflectivity loss for the outer ring A2.

Figure 8:
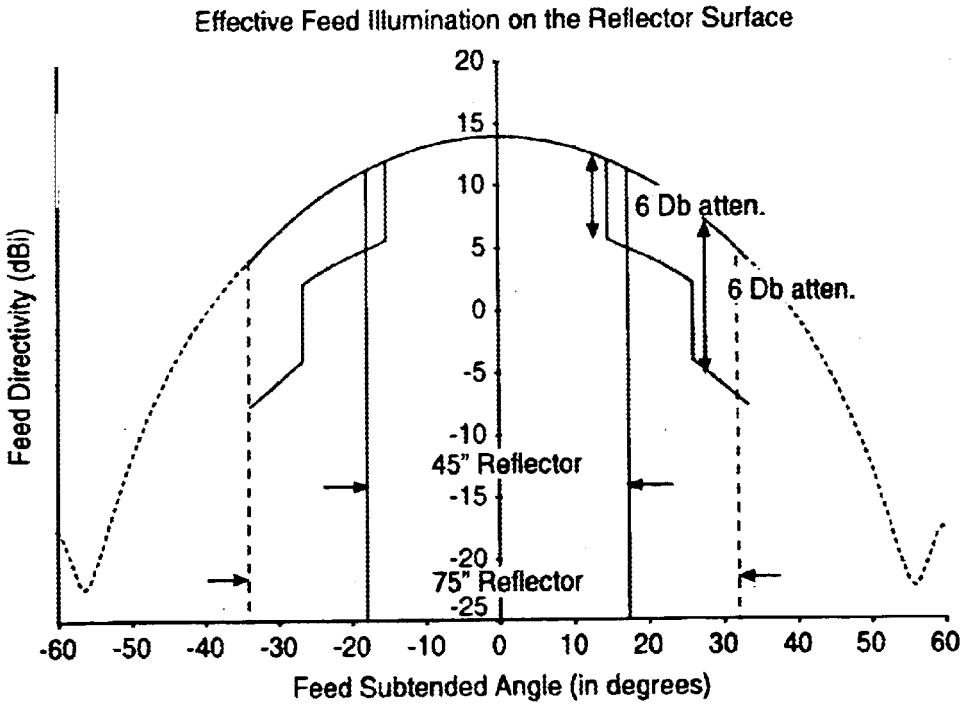
FIG. 8 is a feed directivity versus subtended angle plot for a reflector according to the present invention.

Referring now to FIG. 8, the effective feed illumination on the reflector of the present invention is illustrated. In this embodiment a 75 inch diameter reflector using a 0.9 inch Potter horn at 20 GHz frequency is illustrated. The illumination on a conventional 45 inch solid reflector is illustrated for comparison. The conventional reflector has an illumination taper of only 3.0 dB while the reflector of the present invention has a 21 dB effective illumination taper. Spillover losses have been computed at 3.1 dB for the conventional reflector and only 0.8 dB for the hybrid reflector. The illumination taper with the hybrid reflector yields higher beam directivity and very low sidelobe levels compared to the conventional reflector.

Figure 9:
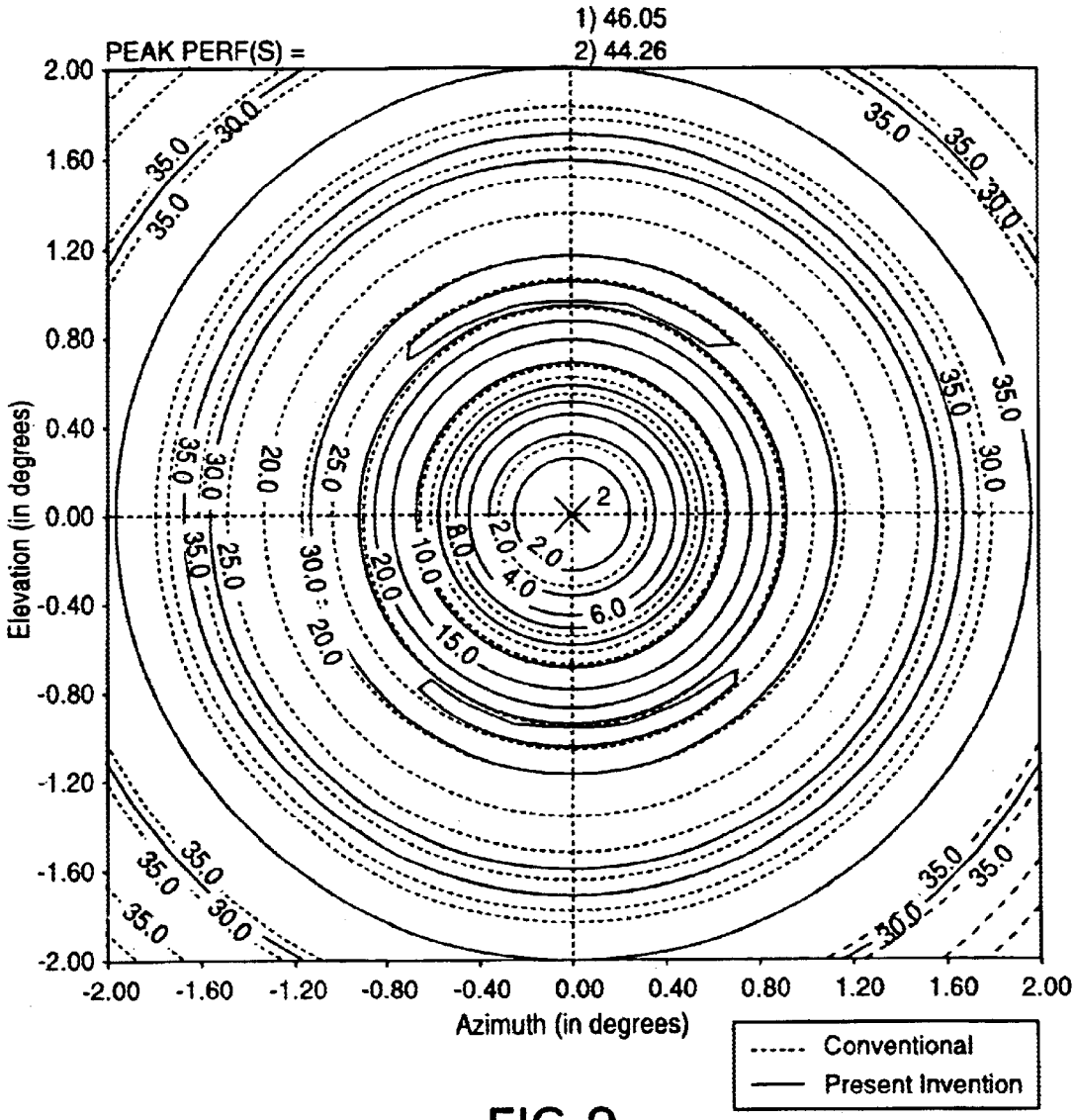
FIG. 9 is a contour plot of the reflector in comparison to that of a conventional reflector.

Referring now to FIG. 9, a contour of the present invention versus those of a conventional reflector (dotted lines) are illustrated. The peak reflectivity value for the present invention is 46.05 dB while the directivity for a conventional reflector is 44.26 dB. The peak directivity improvement in the present invention is about 1.8 dB.

Figure 10A:
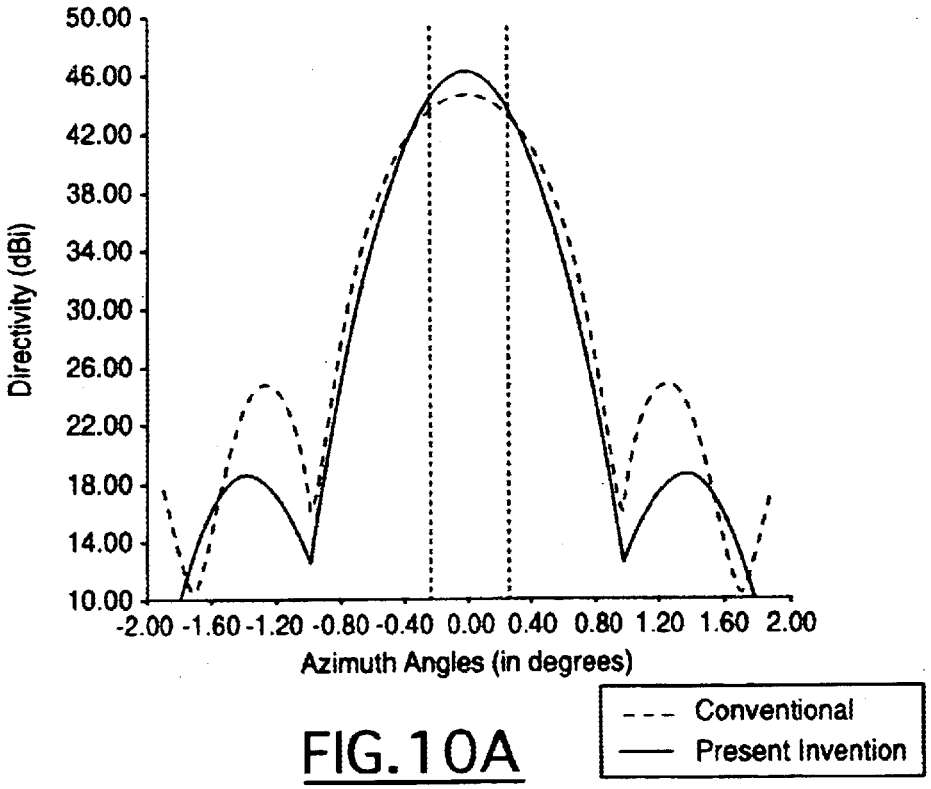
FIG. 10A is a directivity versus azimuth angle radiation pattern according to the present invention in comparison to a conventional reflector.
Figure 10B:
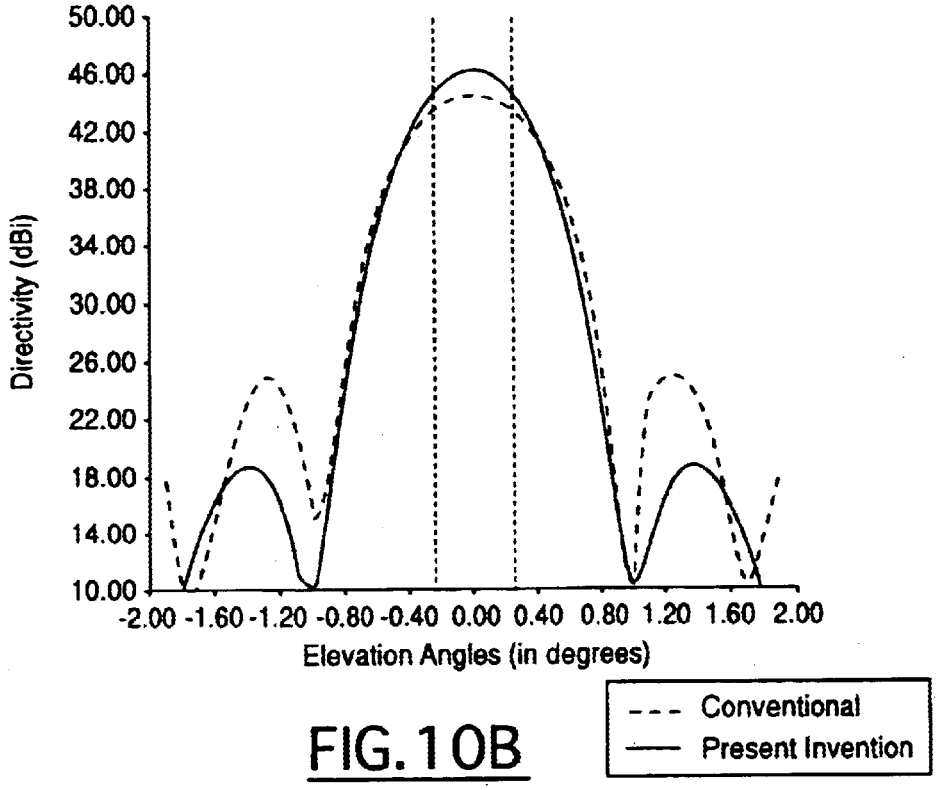
FIG. 10B is a directivity versus elevation angle plot for a radiation pattern of the present invention versus a conventional reflector.

Referring now to FIGS. 10A and 10B, the respective directivity patterns as a function of azimuth and elevation angles are illustrated. The peak sidelobe levels are −19 dB and −27 dB relative to the peak directivity for the conventional reflector and the hybrid reflector of the present invention, respectively. The sidelobe levels are improved by about 8.5 dB in the present invention.

Figure 11:
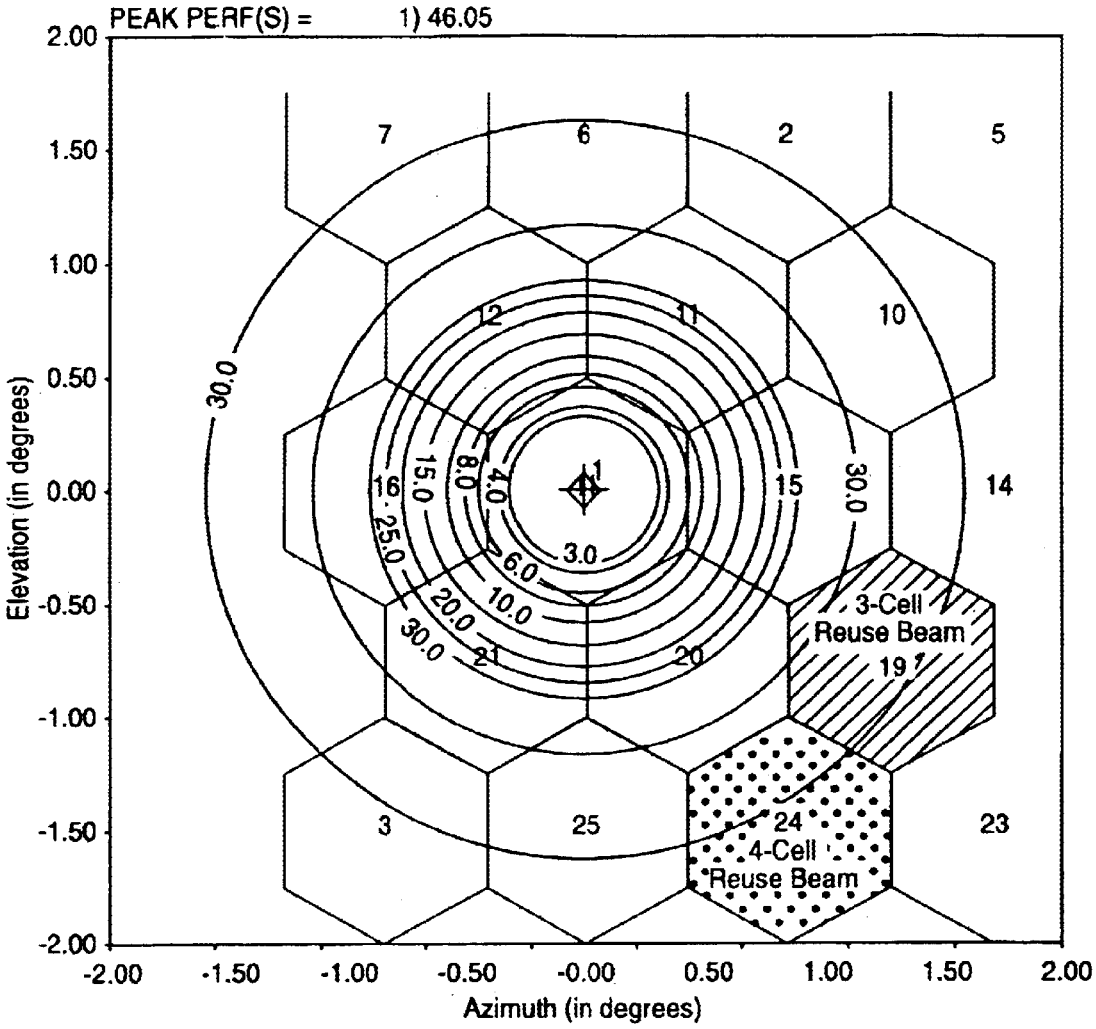
FIG. 11 is an elevation angle versus azimuth plot illustrating isolation levels on frequency reuse cells.

Referring now to FIG. 11, a copolar contour plot of the present invention. The copolar isolation due to the single interferer without satellite pointing error is 20 dB for a three-cell reuse scheme and 23 dB for a four-cell reuse scheme. The isolation values including typical satellite pointing errors are about 16 dB and 19 dB for the three-cell and four-cell reuse schemes, respectively. The copolar isolation values improve with the reflector of the present invention by at least 5 dB compared to a conventional reflector. Further improvements may be obtained by optimizing the parameters of the present invention such as the shape and size of the outer rings, varying the radii of the different regions and the attenuation values for the annular regions of the hybrid reflector.

Figure 12A:
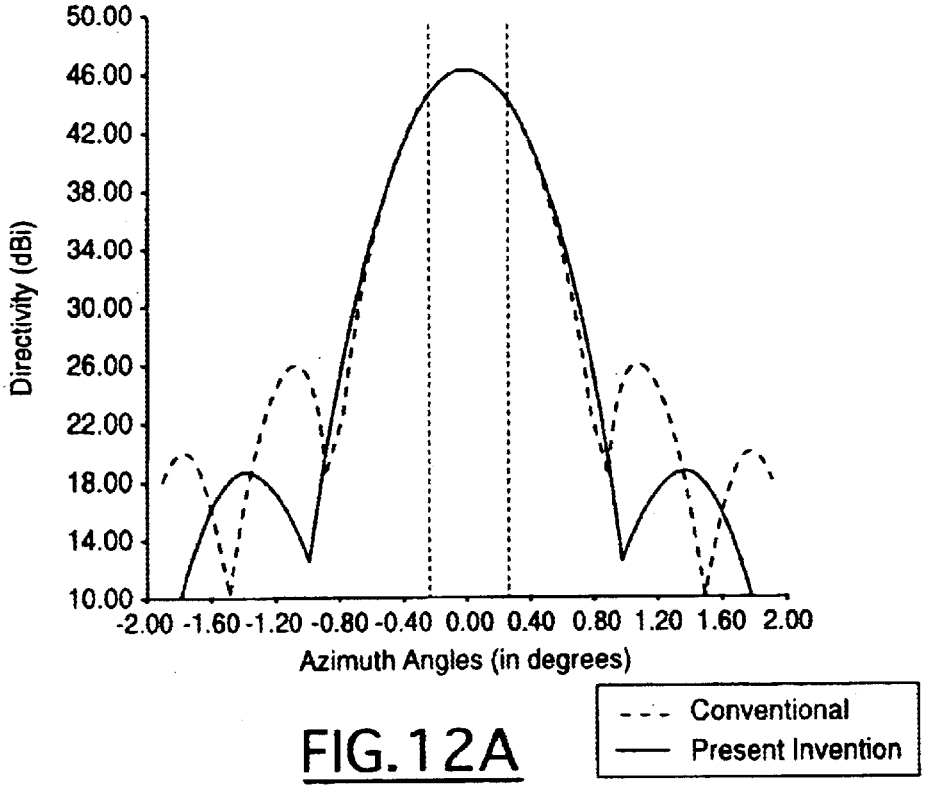
FIG. 12A is a directivity versus azimuth angle plot for a reflector formed according to the present invention in a conventional reflector when the conventional reflector and the present invention have the same peak directivity.
Figure 12B:
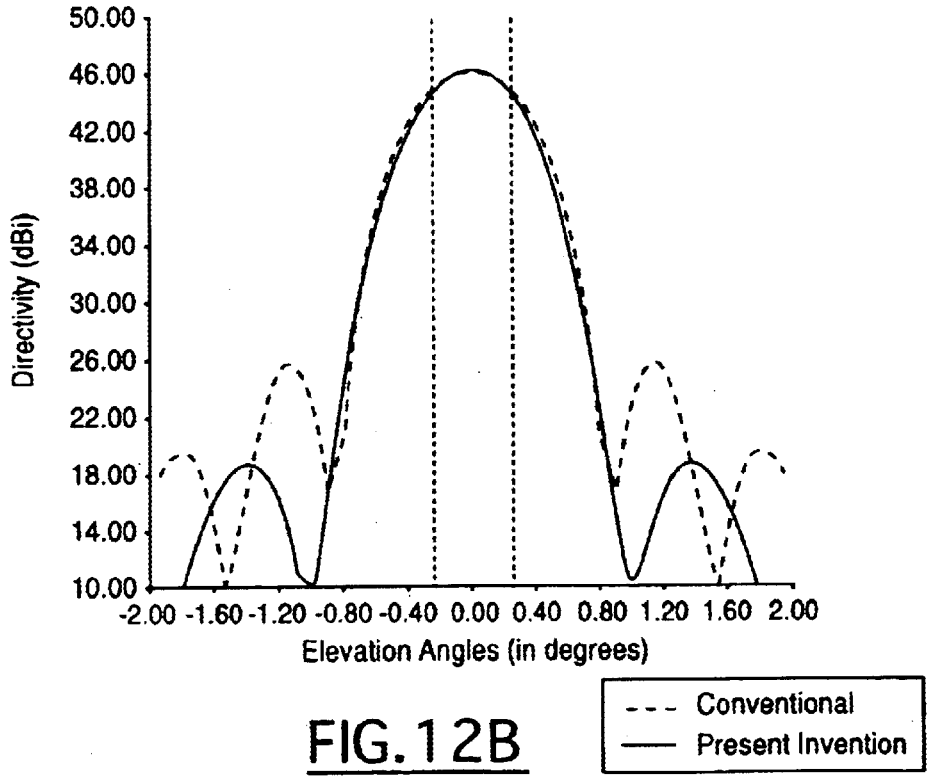
FIG. 12B is a directivity versus elevation angle plot of a reflector formed according to the present invention.

Referring now to FIGS. 12A and 12B, a comparison of the conventional reflector that has been increased from 45 inches to 51.75 inches has a directivity value that is identical to that using the hybrid reflector of the present invention. Although the peak directivity values and the main beam roll-off are very similar for both designs, the sidelobe levels are improved by about 7.5 dB with the reflector design of the present invention.

As can be seen, the present invention provides a significant advantage in that the recurring cost of the multiple beam antenna system may be reduced by about 50 percent due to the reduced number of reflectors (from 6 or 8 to only 2). Also, the overall mass of the antennas is also reduced about 30 percent. Because the design requires less space to occupy the spacecraft, more space may be used for various payloads.

While particular embodiments of the invention have been shown and described, numerous variations and alternate embodiments will occur to those skilled in the art. Accordingly, it is intended that the invention be limited only in terms of the appended claims.

What is claimed is:

1. An antenna hybrid reflector operating over a frequency band comprising:

a central portion fully reflective to said frequency band; and a first annular band disposed directly adjacent to said central portion, said first annular band partially reflective to said frequency band and partially absorptive to said frequency band.

2. An antenna hybrid reflector as recited in claim 1 further comprising a second annular band disposed directly adjacent to said first annular central portion, said second annular bend partially reflecting said frequency band.

3. An antenna reflector as recited In claim 2 wherein the second annular band has a different attenuation level than said first annular band.

4. An antenna hybrid reflector as recited in claim 2 wherein the second annular band has a greater attenuation level than said first annular band.

5. An antenna hybrid reflector as recited in claim 1 wherein said central portion is circular.

6. An antenna hybrid reflector as recited in claim 1 wherein said first portion is concentric with said central portion.

7. An antenna hybrid reflector operating over a frequency band comprising:

a central portion fully reflecting said frequency band; and a first annular band disposed directly adjacent to said central portion, said first annular band having a first resistance to partially reflect and partially absorb said frequency band.

8. An antenna hybrid reflector as recited in claim 7 further comprising a second annular band disposed directly adjacent to said first annular central portion, said second annular band partially reflecting said frequency band.

9. An antenna hybrid reflector as recited in claim 8 wherein the second annular band has a second resistance different than said first resistance.

10. An antenna hybrid reflector as recited in claim 8 wherein the second annular band has a different attenuation level than said first annular band.

11. An antenna hybrid reflector as recited in claim 8 wherein the second annular band has a greater attenuation level than said first annular band.

12. An antenna hybrid reflector as recited in claim 7 wherein said first portion is concentric with said central portion.

13. A satellite system comprising:

a satellite body;

a transmit antenna assembly coupled to the satellite body comprising, a plurality of transmit feed horns having a transmit frequency band;

a transmit reflector having a first central portion fully reflecting said transmit frequency band and a first annular band disposed directly adjacent to said central portion, said first annular band partially reflective to said transmit frequency band and partially absorptive of said transmit frequency band;

a receive antenna assembly coupled to the satellite body;

a plurality of receive feed horns having a receive frequency band different from the transmit frequency band; and a receive reflector having a first central portion fully reflecting said receive frequency band and, a first annular band disposed directly adjacent to said central portion, said first annular band partially reflective to said receive frequency band and partially absorptive of said receive frequency band.

14. A satellite system as recited in claim 13 wherein each of said plurality of transmit feed horns generates one or multiple beams without a beamforming network.

15. A satellite systems as recited in claim 14 wherein said transmit antenna assembly further comprising a second transmitting annular band disposed directly adjacent to said first central portion, said second transmitting annular band partially reflecting said transmit frequency band.

16. A satellite system as recited in claim 15 wherein the second transmitting annular band has a second resistance different than said first resistance.

17. A satellite system as recited in claim 13 wherein the second transmitting annular band has a different attenuation level than said first annular band.

18. A satellite system as recited in claim 17 wherein the second annular band has a greater attenuation level than said first annular band.

19. A satellite system as recited in claim 18 wherein said receive antenna assembly further comprising a second receive annular band disposed directly adjacent to said first central portion, said second receive annular band partially reflecting said receive frequency band.

20. A satellite system as recited in claim 13 wherein the second receive annular band has a different attenuation level than said first receive annular band.

* * * * *